US010449121B2

(12) United States Patent
Bolten

(10) Patent No.: US 10,449,121 B2
(45) Date of Patent: Oct. 22, 2019

(54) CUSTOMIZED NIPPLES FOR BABY BOTTLES AND PACIFIERS, AND METHODS AND INTERFACES FOR MAKING THE SAME

(71) Applicant: Cassandra F. Bolten, San Diego, CA (US)

(72) Inventor: Cassandra F. Bolten, San Diego, CA (US)

( * ) Notice: Subject to any disclaimer, the term of this patent is extended or adjusted under 35 U.S.C. 154(b) by 147 days.

(21) Appl. No.: 15/589,978

(22) Filed: May 8, 2017

(65) Prior Publication Data

US 2018/0318177 A1 Nov. 8, 2018

(51) Int. Cl.
*A61J 11/00* (2006.01)
*A61J 17/00* (2006.01)

(52) U.S. Cl.
CPC ..... *A61J 11/005* (2013.01); *A61J 17/001* (2015.05)

(58) Field of Classification Search
CPC ..... A61J 11/005; A61J 17/001; A61J 11/04; A61J 17/00
USPC ..... 606/236
See application file for complete search history.

(56) References Cited

U.S. PATENT DOCUMENTS 5,108,686 A 4/1992 Griffin
9,044,379 B2 6/2015 Sabree
9,486,392 B2 11/2016 Kemper
2006/0201901 A1* 9/2006 Sabree ..... A61J 17/001 215/11.1
2008/0314776 A1 12/2008 Cooke
2017/0312186 A1* 11/2017 Lofaro ..... A61J 11/005

OTHER PUBLICATIONS

Dr. Brown's Original Bottles Landing Page, 3 pages, available at https://www.drbrownsbaby.com/original-bottles/ (retrieved May 4, 2017).
Dr. Brown's Baby Dr. Brown's Nipples, 6 pages, available at https://www.drbrownsbaby.com/products/dr-browns-nipples/ (retrieved May 4, 2017).
Dr. Brown's Natural Flow Baby Bottle, 1 page, available at https://www.drbrownsbaby.com/wp-content/uploads/2017/02/en_bottle_instructions.pdf (retrieved May 4, 2017).
Dr. Brown's Natutal Flow Options Bottle, 2 pages, available at https://www.drbrownsbaby.com/wp-content/uploads/2017/02/options-glass-english.pdf (retrieved May 4, 2017).
Impertect Parent—Top 10 Weirdest Baby Bottles, 7 pages, available at http://www.imperfectparent.com/articles/weirdest-baby-bottles/ (retrieved May 4, 2017).
Daddy Types—The Weblog for New Dads—Scan That Breast to Make an Imprint Nipple, 2 pages, Jul. 20, 2006, available at http://daddytypes.com/2006/07/20/scan_that_breast_to_m.

(Continued)

*Primary Examiner* — George J Ulsh

(57) ABSTRACT

Customized nipples are provided herein that are designed to mimic a nursing woman's anatomic nipple to minimize nipple confusion for a nursing baby. The customized nipples are created in a noninvasive manner, for example, via a scan of the woman's breast that is received by a computer. The customized nipples also are preferably formed in an efficient manner based on the scan. The customized nipples may be formed for baby products, such as bottles and pacifiers.

20 Claims, 3 Drawing Sheets

(56) References Cited

OTHER PUBLICATIONS

Evenflo Feeding Bottle Feeding products, 40 pages, available at https://www.evenflofeeding.com/products/bottle-feeding/ (retrieved May 4, 2017).
Wacker Announces New Silicon 3D Printing Technology, 12 pages, Aug. 11, 2015, available at https://3dprint.com/88316/wacker-3d-printed-silicone/ (retrieved May 4, 2017).
ACEO Shop, Imagine your CAD design come to life in 100% silicone, 4 pages, available at https://www.aceo3d.com/shop/ (retrieved May 4, 2017).
Lievendag, Nick, 3DScan Expert—3 Free 3D Scanning Apps that Don't Require Extra Hardware, Jun. 30, 2016, 22 pages, available at http://3dscanexpert.com/3-free.

* cited by examiner

CUSTOMIZED NIPPLES FOR BABY BOTTLES AND PACIFIERS, AND METHODS AND INTERFACES FOR MAKING THE SAME

I. TECHNICAL FIELD

This technology generally relates to customized nipples for baby products such as bottles and pacifiers, and efficient methods of making the same.

II. BACKGROUND

There are a number of baby bottles and pacifiers currently on the market. Oftentimes, especially in the first few months in a baby's life, a nursing woman is counseled that use of a pacifier or bottle would be unwise as the baby may develop "nipple confusion" from the pacifier/bottle and thereafter reject the woman's breast for nursing. Accordingly, there is a need for a nipple designed to minimize the risks of such nipple confusion.

U.S. Pat. No. 9,044,379 to Sabree describes a customized nipple using a mold to create a replica of the mother's breast. The nipple in Sabree suffers from a number of drawbacks in that a physical mold of the woman's breast is required. In practice, however, women would generally prefer that a physical mold not be required for making the nipple replica.

U.S. Pat. No. 5,108,686 to Griffin and U.S. Patent App. Pub No. 2008/0314776 to Cooke are further examples of customized nipples, yet both these examples also require a mold for forming the customized nipple.

Design Continuum proposed a customized nipple design in a socket wrench-like bottle that simulated the mother's breast. Such a design was criticized and never appeared to make it to market. The design suffered from drawbacks such as incompatibility with practical bottle designs.

There is a need for a nipple for baby products that is customized to the nursing woman's actual nipple and is formed is a noninvasive, efficient manner.

III. SUMMARY

Customized nipples are provided herein that are designed to mimic a nursing woman's anatomic nipple to minimize nipple confusion for a nursing baby. The customized nipples are created in a noninvasive manner, for example, via a scan of the woman's breast that is received by a computer. The customized nipples are formed in an efficient manner, preferably, within a short time period after the scan. The customized nipples may be formed using a device, e.g., a three-dimensional printer, located in the same location as the scanner for fast nipple replication. Advantageously, in such instances, the nursing woman's nipple may be scanned and the customized nipple formed in a single location in a relatively short amount of time (e.g., less than one hour). For example, the customized nipple formation system may be located in a hospital or doctor's office where a nursing woman can conveniently be scanned and receive the customized nipple in a single visit, as well as at home or during a meeting with a lactation consultant. The system could also be mobile, e.g., on a movable cart, that could be moved to the nursing woman. As another example, aspects on the system could be embodied in software downloaded to a computer that utilizes components of the computer for aspects of the scanning and formation process described herein. The customized nipples are preferably formed for baby products, such as bottles and pacifiers.

In accordance with one aspect of the present invention, systems and methods are provided for forming a customized nipple for use in a baby product. The system may include a user interface to receive user input such as selections on bottle and/or pacifier information and may display information to the user associated with the customized nipple. A scanner is designed to scan a nursing woman's nipple to generate data indicative of the size and shape of the nursing woman's nipple. A forming unit is designed to form the customized nipple based on the data indicative of the size and shape of the nursing woman's nipple such that the customized nipple mimics the size and shape of the nursing woman's nipple. The method may include receiving user input associated with the customized nipple at a user interface; scanning a nursing woman's nipple to generate data indicative of size and shape of the nursing woman's nipple; and forming the customized nipple based on the data indicative of the size and shape of the nursing woman's nipple such that the customized nipple mimics the size and shape of the nursing woman's nipple.

The user input may include user identification information stored from account creation allowing a user to login at a later time. The user input may include information about a selected size of bottle for the customized nipple. The user may select a type of bottle from a catalog of bottle types such that the customized nipple is compatible with the selected type of bottle.

The portion of the customized nipple that mimics the size and shape of the nursing woman's nipple may be formed with a base ring such that the customized nipple is interchangeable with a plurality of bottles. The mimic nipple portion and the base ring may be integrally formed from a common material. Additionally, the customized nipple may include an intermediate portion with an outer diameter greater than the outer diameter at the mimic nipple portion, but smaller than the outer diameter at the base ring. In such embodiments, the mimic nipple portion, the intermediate portion, and the base ring may be integrally formed from a common material. The customized nipple may be formed on a pacifier base to create a customized pacifier.

Before scanning the nursing woman's nipple, the nursing woman's nipple is preferably prepared for scanning. For example, the nursing woman's nipple may be pumped with a breast pump. The system may instruct the nursing woman to prepare the nursing woman's nipple before the scan. The scan of the nursing woman's nipple and the formation of the customized nipple may occur at the same location. The customized nipple may be formed by printing the customized nipple. Preferably, the customized nipple is formed of a material selected to mimic the feel of the nursing woman's nipple such as silicone, rubber, poly vinyl chloride, or latex, or combinations thereof.

One or more additional customized nipples may be formed based on the data indicative of the size and shape of the nursing woman's nipple such that the customized nipple mimics the size and shape of the nursing woman's nipple. Such nipples may be formed immediately after the formation of the first customized nipple or at a later date.

A bottle is provided herein that includes the customized nipple. A pacifier also is provided herein that includes the customized nipple.

In accordance with another aspect of the present invention, a non-transitory computer readable medium is provided herein for forming a customized nipple for use in a baby product. Instructions are stored on the medium that, when executed by a processor, cause the processor to, for example, receive user input associated with a customized nipple at a user interface; initiate a scanning protocol to scan a nursing woman's nipple to generate data indicative of size and shape of the nursing woman's nipple; and initiate formation of the customized nipple based on the data indicative of the size and shape of the nursing woman's nipple such that the customized nipple mimics the size and shape of the nursing woman's nipple.

The user input may include user login information and the non-transitory computer readable medium may be configured to store the data indicative of the size and shape of the nursing woman's nipple. The instructions, when executed by the processor, may cause the processor to form another customized nipple based on the stored data indicative of the size and shape of the nursing woman's nipple such that the customized nipple mimics the size and shape of the nursing woman's nipple. The user input also may include a selection of a bottle or pacifier.

IV. BRIEF DESCRIPTION OF THE DRAWINGS

FIG. 1A shows an embodiment of an exemplary customized nipple on a bottle while

V. DETAILED DESCRIPTION OF THE INVENTION

Customized nipples are provided herein that are designed to mimic a nursing woman's anatomic nipple to minimize nipple confusion for a nursing baby. The customized nipples are created in a noninvasive manner, for example, via a scan of the woman's breast that is received by a computer. The customized nipples also are preferably formed in an efficient manner within a short time period after the scan. The woman's nipple may be scanned and the customized nipple formed in a single location. The customized nipples are preferably formed for baby products, such as bottles and pacifiers.

Figure 1A:
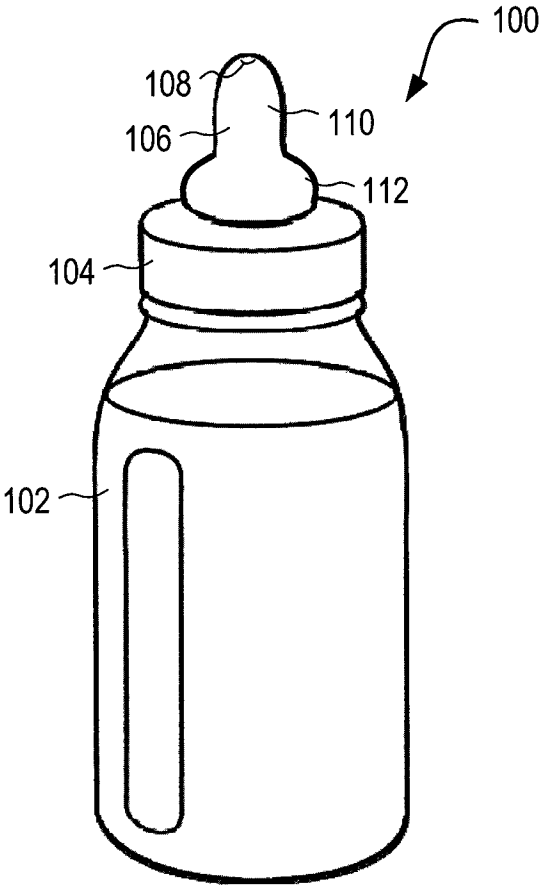

Referring to FIG. 1A, an exemplary customized nipple on a bottle is shown. Bottle 100 illustratively includes container 102, cap 104, and customized nipple 106. Container 102 holds fluid such as breast milk. Cap 104 is removably coupled to container 102, for example, via corresponding threads. Cap 104 has an aperture to receive customized nipple 106 therethrough. Container 102 and cap 104 may be a commercially available baby bottle such as Dr. Brown's Natural Flow Standard bottles from Handi-Craft Company of St. Louis, Mo. or of U.S. Pat. No. 9,486,392 to Kemper, the entire contents of which are incorporated herein by reference, or Evenflo classic or advanced angled bottles of Evenflo Feeding, Inc. of West Chester, Ohio. As will be readily apparent to one skilled in the art, bottle 100 may have additional components such as anti-colic tubing.

Customized nipple 106 is sized and shaped to mimic a nursing woman's anatomic nipple to minimize nipple confusion for a nursing baby. Customized nipple 106 may be constructed to be interchangeable with the nipple of a commercially available bottle. For example, a user may select the type of bottle for use with customized nipple 106 and the systems described herein will construct the nipple to fit to the bottle based on data stored in memory of the systems. Customized nipple 106 is formed of a material selected to mimic feel of the nursing woman's nipple such as silicone, rubber, poly vinyl chloride, or latex, or combinations thereof. In embodiments where customized nipple 106 is designed for use in a bottle, customized nipple 106 has hole 108 through which the baby can suck fluid, e.g., breast milk. The size of hole 108 may be selected by the user based on the baby's perceived preference. Hole sizes known in the art such as size 1, 2, 3, 4, 5, etc. may be selected and the hole size formed based on the selection. Illustratively, customized nipple 106 has mimic nipple portion 110 and intermediate portion 112. Mimic nipple portion 110 mimics the size and shape of the nursing woman's nipple based on the scan as described herein. Intermediate portion 112 has an outer diameter greater than the greatest outer diameter of mimic nipple portion 110, but smaller than the inner diameter of the aperture of cap 104 to permit cap 104 to receive customized nipple 106 through the aperture although a portion of customized nipple 106 remains between cap 104 and container 102.

Figure 1B:
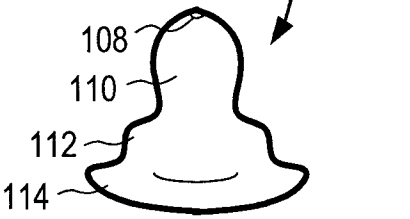
FIG. 1B shows the exemplary customized nipple of FIG. 1A constructed in accordance with the principles of the present invention.

FIG. 1B illustrates an exemplary standalone customized nipple 106 formed in accordance with the principles of the present invention. Customized nipple 106 has mimic nipple portion 110 and intermediate portion 112 as well as base ring 114 to maintain customized nipple 106 in cap 104 when bottle 100 is assembled. Base ring 114 has an outer diameter greater than the inner diameter of the aperture of cap 104. Mimic nipple portion 110, intermediate portion 112, and base ring 114 may be integrally formed from a common material. Additionally, customized nipple 106 may be a standalone unit that is interchangeable with a plurality of bottles. As shown, the longitudinal axis of mimic nipple portion 110 is aligned with a longitudinal axis of container 102 for usability and interchangeability. The longitudinal axis of container 102 may extend through the full length of container 102 or may extend through part of the length of container 102, for example, when a portion of container 102 is angled at a predetermined angle such as 45 degrees.

Figure 1C:
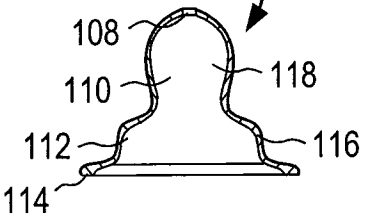
FIG. 1C is a cross-sectional view of the exemplary customized nipple of FIG. 1B.

FIG. 1C is a cross-sectional view of customized nipple 106 of FIG. 1B. Wall 116 of customized nipple 106 defines cavity 118 such that fluid can travel from container 102 into cavity 118 and out of hole 108 for consumption. Wall 116 may have a generally uniform thickness although the thickness can vary.

Figure 2:
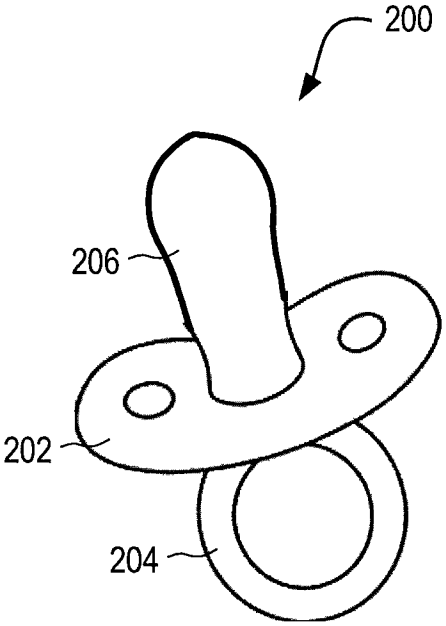
FIG. 2 shows an embodiment of an exemplary customized nipple on a pacifier constructed in accordance with the principles of the present invention.

Referring now to FIG. 2, an exemplary customized nipple on a pacifier is shown. Pacifier 200 illustratively includes pacifier base 202, handle 204, and customized nipple 206. Pacifier base 202 is coupled to, or integrally formed with, handle 204 and/or customized nipple 206. Pacifier base 202 is a support structure for customized nipple 206.

Customized nipple 206 is sized and shaped to mimic a nursing woman's anatomic nipple to minimize nipple confusion for a nursing baby. Customized nipple 206 may be constructed to be formed on a commercially available pacifier base with a handle. For example, a user may select the type of pacifier for use with customized nipple 206 and the systems described herein will construct the nipple on a commercially available pacifier base with a handle or may construct pacifier base 202 and handle 204 based on data stored in memory of the systems and construct customized nipple 206 based on the scanned information of the nursing woman's nipple. In this manner, customized nipple 206 may be formed on a plurality of different types of pacifier bases. Customized nipple 206 is formed of a material selected to mimic feel of the nursing woman's nipple such as silicone, rubber, poly vinyl chloride, or latex, or combinations thereof. Customized nipple 206 of pacifier 200 may be hollow or may be solid.

Figure 3:
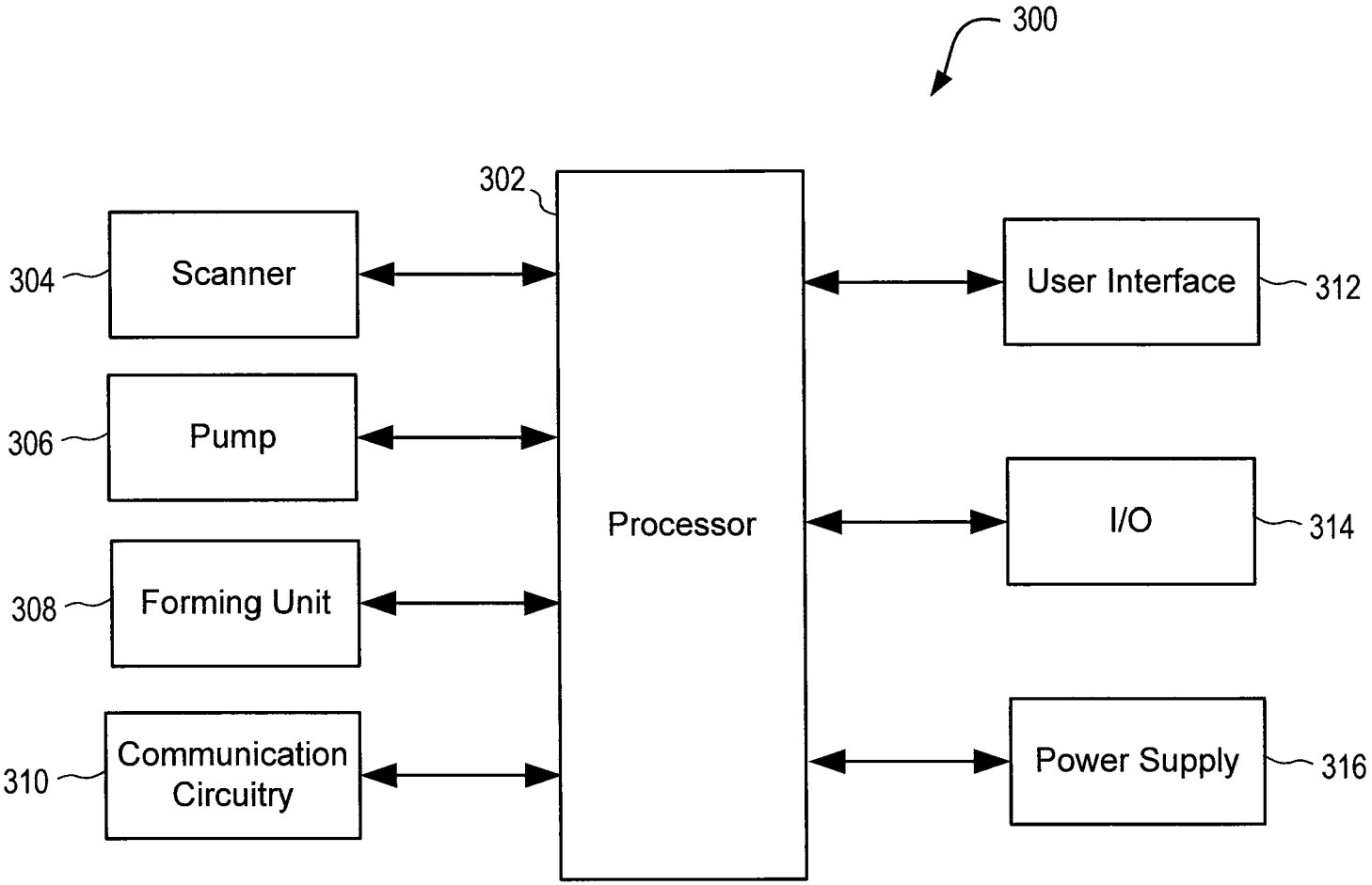
FIG. 3 shows an embodiment of an exemplary system for forming a customized nipple in accordance with the principles of the present invention.

Referring to FIG. 3, a generalized schematic diagram of an exemplary system for forming a customized nipple in accordance with the principles of the present invention is now described. Customized nipple formation system 300 may include processor 302, scanner 304, pump 306, forming unit 308, communication circuitry 310, user interface 312, input and output circuitry (I/O) 314, and/or power supply 316. The components of customized nipple formation system 300 may be located in a single location or may be in more than one location. In one embodiment, the components of customized nipple formation system 300 are at least partially disposed within a common housing. In other aspects, multiple housings are used. Additionally, some or all of the components may be directly electrically coupled or may be electrically coupled via a network such as the Internet.

Processor 302 may be electrically coupled to, and may control, the functional components of customized nipple formation system 300. Processor 302 may comprise one or more commercially available microcontroller units that may include a programmable microprocessor, volatile memory, nonvolatile memory such as EEPROM for storing programming, and nonvolatile storage, e.g., Flash memory, for storing firmware and a log of user data and baby product catalogs. The memory of processor 302 stores program instructions that, when executed by processor 302, cause processor 302 and the functional components of customized nipple formation system 300 to provide the functionality ascribed to them herein. Processor 302 is configured to be programmable such that programming data is stored in the memory of processor 302 or accessible via a network. As will be readily understood to one skilled in the art, while FIG. 3 is illustrated to show one processor, multiple processor may be utilized in a single location or multiple locations. Processor 302 may store user information and/or product catalog information in its memory or in memory accessible via a network, e.g., the Internet. For example, the memory may store information on a variety of commercially available baby bottles such that the customized nipple formed is compatible with the commercially available baby bottle. In this manner, a user may select the type of baby bottle for use with the customized nipple formed by the system. Additionally, or alternatively, the system could store various commercially available baby bottles and/or pacifier bases and handles selectable via a user interface and optionally visible in a vending machine-type format. In one embodiment, processor 302 is a processor in a computer such as a smartphone, laptop, or tablet.

Scanner 304 scans a nursing woman's nipple to generate data indicative of size and shape of the nursing woman's nipple for formation of the customized nipple. Scanner 304 is preferably electrically coupled to processor 302 such that processor 302 receives data indicative of size and shape of the nursing woman's nipple from the scan. Scanner 304 may scan the nursing woman's nipple in a noninvasive manner without the need to contact the nipple, breast, or skin for the scan. Scanner 304 may take multiple photographs of the nursing woman's nipple that are combined by processor 302 to render a three-dimensional image of the nursing woman's nipple. Additionally, processor 302 may direct scanner 304 to initiate the scanning protocol responsive to user input received at the user interface. For example, once the nursing woman's nipple is in the feeding state, the user may select "Begin Scan" at the user interface which causes scanner 304 to start scanning the nipple. The user interface may also provide instructions on photographing the nipple based on commands from processor 302. For example, the user interface may instruct the woman to take photographs of the nursing woman's nipple at predetermined viewing angles for rendering the three-dimensional image such as a top view, bottom view, front view, right side view, and/or left side view. Scanner 304 may utilize technology known in CAD/CAM fields for scanning the nursing woman's nipple and processing the scan for formation of the customized nipple. A scanner from CADScan of Chester, UK may be used. In one embodiment, scanner 304 uses the camera of a computer such as a smartphone, laptop, or tablet for scanning the nursing woman's nipple.

Pump 306 pumps the nipple such that the nipple transitions to the feeding state. For an accurate replica of the nursing woman's nipple to avoid nipple confusion, it is important that the customized nipple mimic the nipple in the feeding state. Pump 306 may be a commercially available breast pump. Pump 306 may be electrically coupled to processor 302 to direct pump 306 to initiate pumping responsive to user input received at the user interface. For example, the user may select "Begin Pumping" at the user interface which causes pump 306 to start pumping the nipple. Alternatively, the user may activate pump 306 when prompted by a message at the user interface. As an alternative to pump 306, the user interface may prompt the nursing woman to prepare the nipple, at which time the nursing mother has the baby latch on the nipple to feed to transition the nipple to the feeding state.

Forming unit 308 forms the customized nipple based on the data indicative of the size and shape of the nursing woman's nipple from the scan by scanner 304. In this manner, the customized nipple mimics the size and shape of the nursing woman's nipple. Additionally, forming unit 308 forms the customized nipple from a material selected to mimic feel of the nursing woman's nipple such as silicone, rubber, poly vinyl chloride, or latex, or combinations thereof. Forming unit 308 is preferably electrically coupled to processor 302 such that processor 302 causes forming unit 308 to form the customized nipple based on data indicative of size and shape of the nursing woman's nipple from the scan. Additionally, processor 302 may direct forming unit 308 to initiate the forming protocol responsive to user input received at the user interface. Alternatively, processor 302 may direct forming unit 308 to automatically begin forming the customized nipple after an acceptable scan. Forming unit 308 may be a three-dimensional printer and may print the customized nipple from the material selected to mimic feel of the nursing woman's nipple. For example, the 3D printer could print the customized nipple with silicone, rubber, poly vinyl chloride, or latex, or combinations thereof. Forming unit 308 may utilize CAD/CAM technology for forming the nursing woman's nipple. In one embodiment, forming unit 308 need not utilize injection molding techniques to form the customized nipple. For example, forming unit 308 may form a free-standing customized nipple without the need for a mold.

Communication circuitry 310 is configured to transfer information, such as data indicative of the size and shape of the nursing woman's nipple and/or user account information, to a remote location such as a remote server via a network such as the Internet. Communication circuitry 310 may include one or more wireless chipsets; e.g., WiFi, Bluetooth, and/or cellular; configured for wireless communication over a network such as the Internet, a local network, or a telephone network using techniques known in the art. In this manner, data from the nipple scan and/or user account information may be transferred and stored via communication circuitry 310. Communication circuitry 310 may be wireless circuitry in a computer such as a smartphone, laptop, or tablet. Communication circuitry 310 is preferably electrically coupled to processor 302 such that processor 302 causes communication circuitry 310 to transfer information remotely responsive to user input received at the user interface. In one embodiment, processor 302 runs a routine to encrypt information transmitted from communication circuitry as such information may be sensitive for a user. Responsive to user input received at the user interface, processor 310 may cause communication circuitry 310 to transfer data indicative of the size and shape of the nursing woman's nipple such that the customized nipple is formed remotely with forming unit 308. Additionally, a user may set up an account with a secure login such that the user may log in to the account more than once to order additional customized nipples based on data from a new scan or data from a previous scan stored in memory at processor 302 or remotely.

User interface 312 is configured to receive user input and, optionally, to display information to the user. User interface 312 may include buttons for receiving user input and a display, e.g., touchscreen, for displaying information to the user. As will be readily apparent to one skilled in the art, user interface 312 is not limited thereto and may use one or more of a touch screen, a keypad, a microphone, a speaker, a trackball, or the like. A user may, for example, provide user input by pressing the touchscreen to cause processor 302 to scanner 304 to begin the scanning protocol. Then, the scanned nipple may be received and the display of user interface 312 may display the scanned nipple. The display of user interface 312 may further display how the formed customized nipple will look in the selected baby product such as in the selected bottle or pacifier.

Input and output circuitry (I/O) 314 may include ports for data communication such as wired communication with a computer/mobile device and/or ports for receiving removable memory, e.g., SD card, upon which program instructions or data related to scanning and/or forming use may be stored. In one embodiment, I/O 314 comprises a port, and corresponding circuitry, for accepting a cables to electrically couple processor 302 to scanner 304, pump 306, and/or forming unit 310.

Power supply 316 powers one or more of the electrical components of customized nipple formation system 300, and may be a primary cell or battery, a secondary (rechargeable) cell or battery or a combination of both. Alternatively, power supply 316 may be a port to allow customized nipple formation system 300 to be plugged into a conventional wall socket for powering components. In one embodiment, power supply 316 comprises the rechargeable battery of the computer.

Figure 4:
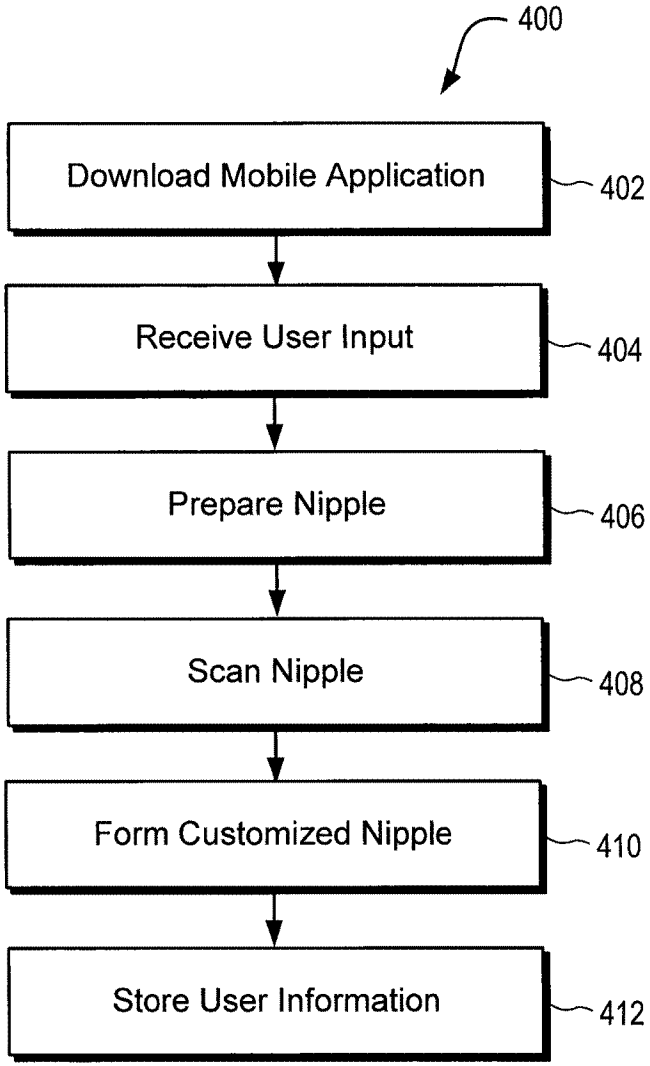
FIG. 4 shows an embodiment of an exemplary method for forming a customized nipple in accordance with the principles of the present invention.

Referring now to FIG. 4, an exemplary method for forming a customized nipple in accordance with the principles of the present invention is shown. As will be apparent to one of ordinary skill in the art, method 400 may be embodied in program instructions stored on the memory of a computer that, when executed by one or more processors, cause the computer to provide the functionality ascribed to them herein. The program instructions may be software downloaded onto the memory of the computer. For example, a mobile application may be downloaded onto non-transitory computer readable media.

At 402, a mobile application is downloaded onto the computer. The mobile application may be a dedicated application or "app" and may be downloaded from an online store such as iTunes™ (Apple, Inc., Cupertino, Calif.), the App Store (Apple, Inc.), Google™ Play (Google, Inc., Mountain View, Calif.), the Android™ Marketplace (Google, Inc.), Windows™ Phone Store (Microsoft Corp., Redmond, Wash.), or BlackBerry™ World (BlackBerry, Waterloo, Ontario, Canada). Preferably, the mobile application need only be downloaded once—although updates may be downloaded—and some or all of the remaining portions of method 400 may be repeated without the need to repeat 402. As will be readily apparent to one skilled in the art, the mobile application is not necessary and a user could instead login via a different mechanism such as a webpage. For example, a customized webpage may be used or a previously available webpage such as amazon.com.

At 404, user input is received at user interface 312. For example, a user (e.g., the nursing woman, a family member, a doctor, nurse, lactation consultant, etc.) may create or log into a personal account. The user may select the type of product to be formed. For example, the user may select a customized nipple for a type and/or size of commercially available bottle from a catalog of commercially available bottle types and/or sizes stored in memory at the processor or stored remotely and accessible via a network such as the Internet. The user could also select the size of the bottle and the size of the hole in the customized nipple. If the user selects a pacifier, the user could select the type of base and/or handle for the pacifier from a catalog of commercially available pacifier base and/or handle types stored in memory at the processor or stored remotely and accessible via a network such as the Internet.

At 406, the nursing woman's nipple is prepared for the scan. Preferably, the nipple is in the feeding state for the scan. To achieve the feeding state, the breast may be pumped with pump 306. Alternatively, the baby may feed on the nursing woman's nipple. User interface 312 may prompt the nursing woman to prepare the nipple such as through a message instructing the nursing woman to begin pumping or to begin a feeding session.

At 408, the nursing woman's nipple is scanned, e.g., via scanner 304, to generate data indicative of size and shape of the nursing woman's nipple for formation of the customized nipple. User interface 312 may permit a user to initiate the scanning protocol, e.g., by pressing a button or the touchscreen to begin the scan of the nipple. The scanned nipple may be displayed on user interface 312 as well as the expected look of the formed baby product with the customized nipple.

At 410, the customized nipple is formed. Preferably, the customized nipple is formed based on the data indicative of the size and shape of the nursing woman's nipple from the scan such that the customized nipple mimics the size and shape of the nursing woman's nipple. If the selected product is a pacifier, the entire pacifier may be formed including the pacifier base, handle, and customized nipple or the customized nipple may be formed on a pre-stored pacifier base with a handle. If the selected product is a bottle, the entire bottle may be formed including the container, cap, and customized nipple or the customized nipple may be formed. The remaining portions of the bottle may be provided from the system or user may use separately purchased bottled parts. In one embodiment, the nursing woman's nipple is scanned and the customized nipple is formed in the same location. Accordingly, the customized nipple may be formed in a relatively fast amount of time (e.g., less than one hour). The customized nipple may be formed by printing the customized nipple, e.g., with a three-dimensional (3D) printer. Preferably, the customized nipple is formed from a material selected to mimic feel of the nursing woman's nipple such as silicone, rubber, poly vinyl chloride, or latex, or combinations thereof.

At 412, the user information is stored. For example, user account information may be stored locally or remotely including user identification information. As such, a user may log back into the account with a secure login to order additional customized nipples based on data from a new scan or data from a previous scan stored in memory at processor 302 or stored in memory remotely, e.g., remote server, cloud.

Customized nipple formation system 300 is well suited for in-home use, at a doctor's office, at a hospital, with a lactation consultant, etc., which could each be in a single room. Customized nipple formation system 300 could be in mobile form such as on a mobile cart or in a lockable booth located at a commercial area such as a mall.

While various illustrative embodiments of the invention are described above, it will be apparent to one skilled in the art that various changes and modifications may be made therein without departing from the invention. The appended claims are intended to cover all such changes and modifications that fall within the true scope of the apparatus and methods of the present invention.

What is claimed:

1. A method of forming a customized nipple for use in a baby product, the method comprising:

receiving user input associated with the customized nipple at a user interface, wherein receiving the user input comprises selecting a type of bottle from a catalog of bottle types;

scanning a nursing woman's nipple to generate data indicative of size and shape of the nursing woman's nipple; and forming the customized nipple based on the data indicative of the size and shape of the nursing woman's nipple such that the customized nipple mimics the size and shape of the nursing woman's nipple.

2. The method of claim 1, wherein receiving the user input comprises receiving user identification information.

3. The method of claim 1, wherein receiving the user input comprises receiving information about a selected size of the type of bottle for the customized nipple.

4. The method of claim 1, wherein forming the customized nipple comprises integrally forming a portion of the customized nipple that mimics the size and shape of the nursing woman's nipple and a base ring from a common type of material such that the customized nipple is interchangeable with a plurality of bottles, wherein the common type of material is selected from silicone, rubber, poly vinyl chloride, or latex, or combinations thereof.

5. The method of claim 1, wherein scanning the nursing woman's nipple and forming the customized nipple occur at the same location.

6. The method of claim 1, further comprising, before scanning the nursing woman's nipple, preparing the nursing woman's nipple for scanning.

7. The method of claim 6, wherein preparing the nursing woman's nipple comprises pumping the nursing woman's nipple with a breast pump.

8. The method of claim 6, wherein preparing the nursing woman's nipple comprises instructing the nursing woman to prepare the nursing woman's nipple.

9. The method of claim 1, wherein forming the customized nipple comprises printing the customized nipple.

10. The method of claim 1, wherein forming the customized nipple comprises forming the customized nipple of a material selected from silicone, rubber, poly vinyl chloride, or latex, or combinations thereof.

11. The method of claim 1, further comprising forming a second customized nipple based on the data indicative of the size and shape of the nursing woman's nipple such that the second customized nipple mimics the size and shape of the nursing woman's nipple.

12. A method of forming a customized nipple for use in a baby product, the method comprising:

receiving user input associated with the customized nipple at a user interface wherein receiving the user input comprises selecting a type of pacifier from a catalog of pacifier types;

scanning a nursing woman's nipple to generate data indicative of size and shape of the nursing woman's nipple; and forming the customized nipple based on the data indicative of the size and shape of the nursing woman's nipple such that the customized nipple mimics the size and shape of the nursing woman's nipple.

13. The method of claim 12, wherein forming the customized nipple comprises forming the customized nipple on a pacifier base.

14. The method of claim 12, wherein receiving the user input comprises receiving user identification information.

15. The method of claim 12, wherein scanning the nursing woman's nipple and forming the customized nipple occur at the same location.

16. The method of claim 12, further comprising, before scanning the nursing woman's nipple, preparing the nursing woman's nipple for scanning.

17. The method of claim 16, wherein preparing the nursing woman's nipple comprises pumping the nursing woman's nipple with a breast pump.

18. The method of claim 16, wherein preparing the nursing woman's nipple comprises instructing the nursing woman to prepare the nursing woman's nipple.

19. The method of claim 12, wherein forming the customized nipple comprises printing the customized nipple.

20. The method of claim 12, further comprising forming a second customized nipple based on the data indicative of the size and shape of the nursing woman's nipple such that the second customized nipple mimics the size and shape of the nursing woman's nipple.

* * * * *